US009676109B2

(12) United States Patent
Yu

(10) Patent No.: US 9,676,109 B2
(45) Date of Patent: Jun. 13, 2017

(54) SHAVER, SHAVER CUTTING MESH, AND PROCESS FOR MANUFACTURING SHAVER CUTTING MESH

(71) Applicant: WENZHOU RUNWE ELECTRICAL APPLIANCE CO., LTD., Wenzhou, Zhejiang (CN)

(72) Inventor: Guangmei Yu, Zhejiang (CN)

(73) Assignee: WENZHOU RUNWE ELECTRICAL APPLIANCE CO., LTD., Wenzhou, Zhejiang (CN)

( * ) Notice: Subject to any disclaimer, the term of this patent is extended or adjusted under 35 U.S.C. 154(b) by 0 days.

(21) Appl. No.: 15/107,082

(22) PCT Filed: Feb. 13, 2014

(86) PCT No.: PCT/CN2014/072021

§ 371 (c)(1),
(2) Date: Jun. 21, 2016

(87) PCT Pub. No.: WO2015/096276

PCT Pub. Date: Jul. 2, 2015

(65) Prior Publication Data

US 2017/0028575 A1 Feb. 2, 2017

(30) Foreign Application Priority Data

Dec. 23, 2013 (CN) ..... 2013 1 0714564

(51) Int. Cl.
*B26B 19/14* (2006.01)
*B26B 19/38* (2006.01)

(52) U.S. Cl.
CPC ..... *B26B 19/143* (2013.01); *B26B 19/3893* (2013.01)

(58) Field of Classification Search
CPC .. B26B 19/143; B26B 19/3893; B26B 19/141
(Continued)

(56) References Cited

U.S. PATENT DOCUMENTS 4,630,370 A * 12/1986 Hamada ..... B26B 19/14 30/346.51
2003/0070304 A1* 4/2003 Curello ..... B26B 19/14 30/346.51

(Continued)

FOREIGN PATENT DOCUMENTS

CN 2480119 Y 3/2002
CN 101254596 A 9/2008

(Continued)

*Primary Examiner* — Omar Flores Sanchez
(74) *Attorney, Agent, or Firm* — Christensen, Fonder, Dardi & Herbert PLLC

(57) ABSTRACT

A shaver, a shaver cutting mesh, and a process for manufacturing the shaver cutting mesh. The process for manufacturing the shaver cutting mesh does not adopt an integral drawing process, but divides the cutting mesh into two parts to be machined, and then completely combines the two parts together by adopting a welding process, so that the mesh surface part is good in uniformity, the radian of the whole mesh surface also can be ensured, the comfort degree and the cleanness in shaving are further improved, and the housing part is machined at a larger thickness (such as 0.5 mm) than that of the mesh surface part to ensure the strength of a whole mesh cover.

14 Claims, 2 Drawing Sheets

(58) Field of Classification Search
USPC ..... 76/101.1, 115, 116; 30/43.6, 346.51, 30/346.61
See application file for complete search history.

(56) References Cited

U.S. PATENT DOCUMENTS

| | | | | |
|---|---|---|---|---|
| 2005/0183267 | A1* | 8/2005 | Okabe | B26B 19/04 30/43.92 |
| 2015/0082637 | A1* | 3/2015 | Liu | B26B 19/143 30/43.6 |

FOREIGN PATENT DOCUMENTS

| | | | |
|---|---|---|---|
| CN | 202147287 | U | 2/2012 |
| CN | 102366962 | A | 3/2012 |
| CN | 202155897 | U | 3/2012 |
| CN | 203019397 | U | 6/2013 |
| CN | 103753608 | A | 4/2014 |
| CN | 203680340 | U | 7/2014 |
| JP | 53-36357 | A | 4/1978 |
| JP | 10-33853 | A | 2/1998 |
| JP | 2014-198059 | A | 10/2014 |
| WO | WO 2013/021514 | A1 | 2/2013 |

* cited by examiner

SHAVER, SHAVER CUTTING MESH, AND PROCESS FOR MANUFACTURING SHAVER CUTTING MESH

RELATED APPLICATIONS

The present application is a National Phase entry of PCT Application No. PCT/CN2014/072021, filed Feb. 13, 2014, which claims priority to Chinese Patent Application No. 201310714564.7, filed Dec. 23, 2013, the disclosures of which are hereby incorporated by reference herein in their entirety.

FIELD OF THE INVENTION

The invention relates to a manufacturing process, in particular to a shaver, a shaver cutting mesh, and a process for manufacturing the shaver cutting mesh.

BACKGROUND ART

There are various shaver products in the current market, and two main types are manual razor blades and electric shavers. The electric shavers are divided into reciprocating type circle razors and rotary type shavers.

Due to relatively good adaptability, the rotary type shavers become more and more popular in the market. With the constant development of the electric shavers, machining of cutting meshes becomes an urgent subject for improvement and research in the current industry. A cutting mesh of a rotary type shaver is a thin-wall and shallow-groove part. The thickness of a mesh surface is required to reach 0.1 mm uniformly, because only the mesh surface with the thicknesses of 0.1 mm can ensure not only comfort degree but also cleanness when used for shaving.

A cutting mesh structure in a plane form appeared earlier, and the cutting mesh is manufactured with the following steps: punching the whole of a metal sheet with a thickness being 0.5 mm to obtain a blank, machining mesh slots, then performing heat treatment, and then performing cutting and grinding on cutting mesh parts in batches. A mesh surface meets the requirement of uniform thickness being 0.1 mm, and a housing at the lower part also has a relatively big thickness. A surface contacted with the skin has a plane structure, general equipment is much, and the measurement is relatively easy, so that the process in a batch production course can be monitored more easily. The cutting mesh structure in the plane form has the advantage that the mesh surface in a plane has an ideal effect for short beards. The disadvantage is that the ability of capturing long beards performs poorly, a user easily feels pulling in beards and the skin feeling is poor.

Later, a cutting mesh structure in an arc surface form appeared, and the cutting mesh with the arc surface is manufactured with the following steps: punching the whole of a material with a thickness being 0.5 mm to obtain a blank, machining mesh slots, then performing heat treatment, and adopting special equipment for independent cutting and grinding, so as to enable the whole mesh surface to meet the requirement of desired thickness being 0.1 mm, and a housing at the lower part to have a relatively big thickness. However, the mesh surface made in this way can reach the thickness of 0.1 mm only in one certain point, so that it is difficult to enable the whole arc surface to reach the thickness of 0.1 mm by adopting the manufacturing process. Because of the arc surface structure, the cutting mesh behaves relatively well in the ability of capturing both long and short beards, and the skin feeling is good. However, the arc surface is difficult to manufacture, high in production cost, and not ideal in effect, which is adverse to the development of the industry.

SUMMARY

In order to overcome defects in the background art, the invention provides a shaver, a shaver cutting mesh, and a process for manufacturing the shaver cutting mesh, and mainly solves the problem that the cutting mesh with an arc surface in the prior art is difficult to manufacture, high in production cost, and not ideal in effect, which is adverse to the development of the industry.

The invention adopts a technical scheme: a shaver cutting mesh comprises a cutting mesh surface and a cutting mesh housing, a plurality of mesh slots are formed in the cutting mesh surface, the lower part of the cutting mesh surface extends to form a welding portion, the cutting mesh housing is a circular ring, a clamp ring is integrally formed on an edge at the lower part of the cutting mesh housing, and the cutting mesh surface is arranged at the upper part of the cutting mesh housing in a sleeving manner and is welded with the cutting mesh housing by the welding portion.

A blade locator is welded at the center of the cutting mesh surface, and is arranged on the inner surface of the cutting mesh surface.

The cutting mesh housing is provided with a circular groove matched with the welding portion.

A shaver comprises a housing, a power supply, an electric motor, and shaving components controlled by a transmission mechanism, and the shaver is provided with the shaver cutting mesh.

A process for manufacturing a shaver cutting mesh comprises the following steps: a, material selection: preparing a metal sheet I with a first thickness and a metal sheet II with a second thickness; b, cutting mesh surface drawing: drawing the metal sheet I to form a cutting mesh surface and extending an edge of the cutting mesh surface to form a welding portion; c, cutting mesh housing stretching: stretching the metal sheet II to form a cutting mesh housing which is a circular ring, and forming a clamp ring on an edge at the lower part of the cutting mesh housing; d, welding: welding the cutting mesh surface with the cutting mesh housing; e, heat treatment.

The metal sheet I is machined to form mesh slots before the cutting mesh surface is drawn.

The cutting mesh surface is machined to form mesh slots after welding and before heat treatment.

The mesh slots are machined and made by adopting a cutting process.

The mesh slots are machined and made by adopting an etching process.

The mesh slots are machined and made by adopting an electrolysis process.

The mesh slots are machined and made by adopting a punching process.

A blade locator is welded at the center of the inner surface of the cutting mesh surface after the cutting mesh surface is drawn and before the cutting mesh housing is stretched.

Burrs are removed after the heat treatment is completed.

An arc surface is manufactured on the cutting mesh surface by adopting a male die of a die to shallowly stretch the middle part of the metal sheet I.

A circular groove matched with the welding portion is machined on the cutting mesh housing.

The metal sheet I is made of a stainless steel material, and the thickness is 0.1 mm.

The metal sheet II is made of a stainless steel material, and the thickness is 0.5 mm.

The invention has the beneficial effects that an integral drawing process is not adopted, the cutting mesh is divided into two parts to be machined, and then the two parts are combined together by adopting a welding process, so that the mesh surface part is good in uniformity, the radian of the whole mesh surface also can be ensured, the comfort degree and the cleanness in shaving are further improved, and the housing part is machined at a thickness (such as 0.5 mm) larger than that of the mesh surface part to ensure the strength of a whole mesh cover.

In the figures, 1—cutting mesh surface, 11—welding portion, 2—cutting mesh housing, 3—circular groove, 4—clamp ring, 5—mesh slot, 6—blade locator

DETAILED DESCRIPTION

Figure 1:
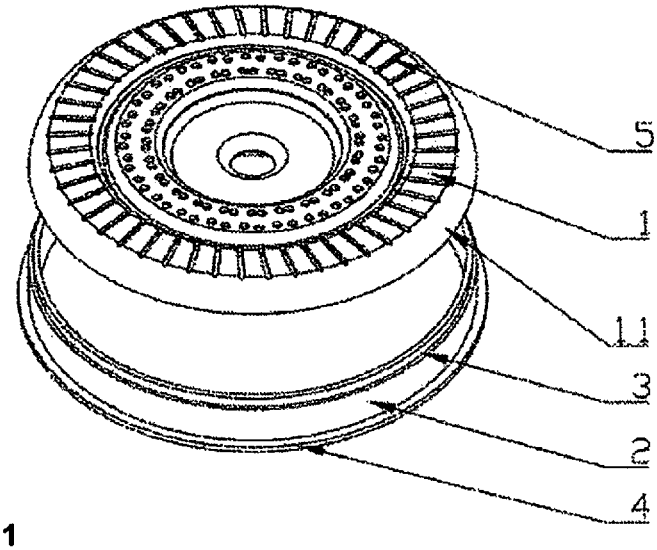
FIG. 1 is an exploded view of a shaver cutting mesh.
Figure 2:
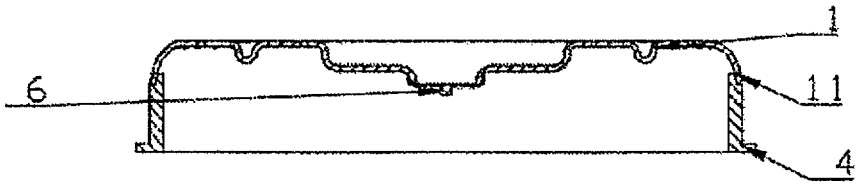
FIG. 2 is a sectional view of a shaver cutting mesh.
Figure 3:
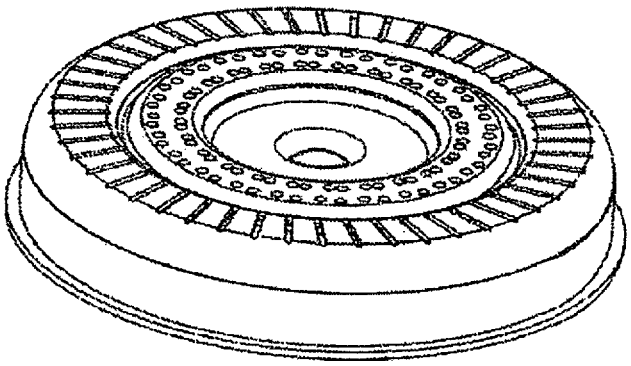
FIG. 3 is a stereogram of a shaver cutting mesh.
Figure 4:
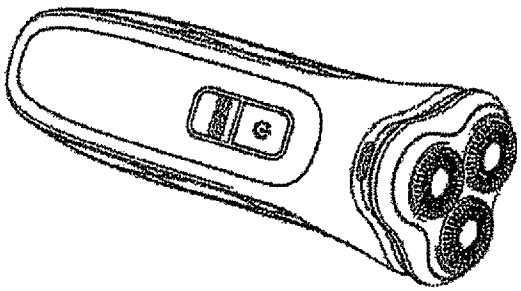
FIG. 4 is a structural schematic diagram of a shaver cutting mesh.

Embodiments of the invention are further described as follows with reference to the drawings:

As shown in FIG. 1 combined with FIGS. 2-4, a shaver cutting mesh comprises a cutting mesh surface 1 and a cutting mesh housing 2, a plurality of mesh slots 5 are formed in the cutting mesh surface 1, the lower part of the cutting mesh surface 1 extends to form a welding portion 11, the cutting mesh housing 2 is a circular ring, a clamp ring 4 is integrally formed on an edge at the lower part of the cutting mesh housing 2, and the cutting mesh surface 1 is arranged at the upper part of the cutting mesh housing 2 in a sleeving manner and is welded with the cutting mesh housing 2 by the welding portion 11.

A blade locator 6 is welded at the center of the cutting mesh surface 1, and is arranged on the inner surface of the cutting mesh surface 1. The blade locator is used for mounting a rotary blade.

The cutting mesh housing 2 is provided with a circular groove 3 matched with the welding portion 11. The shaver cutting mesh has good suitability and is convenient to mount and match.

A shaver comprises a housing, a power supply, an electric motor, and shaving components controlled by a transmission mechanism, and the shaver is provided with the shaver cutting mesh. Because of an arc surface structure, the cutting mesh behaves relatively well in the ability of capturing both long and short beards, and the skin feeling is good.

A process for manufacturing a shaver cutting mesh comprises the following steps: preparing a metal sheet with a thickness being 0.1 mm and a metal sheet with a thickness being 0.5 mm; forming mesh slots 5 in the metal sheet with the thickness being 0.1 mm by cutting and machining; drawing the metal sheet with the machined mesh slots to form a cutting mesh surface 1 and extending an edge of the cutting mesh surface 1 to form a welding portion 11; manufacturing an arc surface on the cutting mesh surface 1 by adopting a male die of a die to shallowly stretch the middle part of the metal sheet with the machined mesh slots; after drawing the cutting mesh surface, welding a blade locator 6 at the center of the inner surface of the cutting mesh surface 1; stretching the metal sheet with the thickness being 0.5 mm to form a cutting mesh housing 2 which is a circular ring, machining the cutting mesh housing 2 to form a circular groove 3 matched with the welding portion 11, and forming a clamp ring 4 on an edge at the lower part of the cutting mesh housing 2; welding the cutting mesh surface 1 with the cutting mesh housing 2; performing heat treatment for the cutting mesh surface 1 and the cutting mesh housing 2; removing burrs after completing the heat treatment.

In the embodiment, the step of machining mesh slots can be put after the step of welding the cutting mesh surface 1 with the cutting mesh housing 2, and then the mesh slots are machined on the cutting mesh surface 1.

In the embodiment, the mesh slots also can be machined by adopting an etching process, an electrolytic machining process, a punching machining process or the like. The machining precision is high, and the yield is high.

The invention has the beneficial effects that an integral drawing process is not adopted, the cutting mesh is divided into two parts to be machined, and then the two parts are completely combined together by adopting a welding process, so that the mesh surface part is good in uniformity, the radian of the whole mesh surface also can be ensured, the comfort degree and the cleanness in shaving are further improved, and the housing part is machined at a thickness (such as 0.5 mm) larger than that of the mesh surface part to ensure the strength of a whole mesh cover.

The invention claimed is:

1. A process for manufacturing a shaver cutting mesh, comprising the following steps: a material selection: preparing a first metal sheet with a first thickness and a second metal sheet with a second thickness; cutting mesh surface drawing: drawing the first metal sheet to form a cutting mesh surface and extending an edge of the cutting mesh surface to form a welding portion; cutting mesh housing stretching: stretching the second metal sheet to form a cutting mesh housing which is a circular ring, and forming a clamp ring on an edge at the lower part of the cutting mesh housing; welding: welding the cutting mesh surface with the cutting mesh housing; and heat treatment.

2. The process for manufacturing a shaver cutting mesh of claim 1, wherein the first metal sheet is machined to form mesh slots before the cutting mesh surface is drawn.

3. The process for manufacturing a shaver cutting mesh of claim 1, wherein the cutting mesh surface is machined to form mesh slots after welding and before heat treatment.

4. The process for manufacturing a shaver cutting mesh of claim 2, wherein the mesh slots are machined and made by adopting a cutting process.

5. The process for manufacturing a shaver cutting mesh of claim 2, wherein the mesh slots are machined and made by adopting an etching process.

6. The process for manufacturing a shaver cutting mesh of claim 2, wherein the mesh slots are machined and made by adopting an etching process.

7. The process for manufacturing a shaver cutting mesh of claim 2, wherein the mesh slots are machined and made by adopting a punching process.

8. The process for manufacturing a shaver cutting mesh of claim 1, wherein a blade locater is welded at the center of the inner surface of the cutting mesh surface after the cutting mesh surface is drawn and before the cutting mesh housing is stretched.

9. The process for manufacturing a shaver cutting mesh of claim 1, wherein burrs are removed after the heat treatment is completed.

10. The process for manufacturing a shaver cutting mesh of claim 1, wherein an arc surface is manufactured on the cutting mesh surface by adopting a male die of a die to shallowly stretch the middle part of the metal sheet I.

11. The process for manufacturing a shaver cutting mesh of claim 1, wherein a circular groove matched with the welding portion is machined on the cutting mesh housing.

12. The process for manufacturing a shaver cutting mesh of claim 1, wherein the metal sheet I is made of a stainless steel material, and the thickness is 0.1 mm.

13. The process for manufacturing a shaver cutting mesh of claim 1, wherein the metal sheet II is made of a stainless steel material, and the thickness is 0.5 mm.

14. A shaver, comprising a housing, a power supply, an electric motor, and shaving components controlled by a transmission mechanism, wherein the shaver is provided with a shaver cutting mesh that is manufactured following the manufacturing process set forth in claim 1.

* * * * *